United States Patent [19]

Prohaska et al.

[11] 4,254,392

[45] Mar. 3, 1981

[54] ELECTROMAGNETIC RELAY

[75] Inventors: Hans Prohaska, Bietigheim-Bissingen; Ulrich Schwarz, Heilbronn, both of Fed. Rep. of Germany

[73] Assignee: ITT Industries, Inc., New York, N.Y.

[21] Appl. No.: 20,648

[22] Filed: Mar. 15, 1979

[30] Foreign Application Priority Data

Mar. 18, 1978 [DE] Fed. Rep. of Germany ..... 2811997

[51] Int. Cl.[3] ..... H01H 50/04

[52] U.S. Cl. ..... 335/202; 335/128

[58] Field of Search ..... 335/202, 128, 135, 133, 335/132, 197, 198

[56] References Cited

U.S. PATENT DOCUMENTS

| | | | |
|---|---|---|---|
| 2,275,924 | 3/1942 | Seeley | 335/128 |
| 3,295,078 | 12/1966 | Hrynewycz | 335/128 |
| 3,980,978 | 9/1976 | Lacan | 335/132 |
| 4,149,131 | 4/1979 | Kawamura et al. | 335/202 |

*Primary Examiner*—Harold Broome

*Attorney, Agent, or Firm*—James B. Raden; Marvin M. Chaban

[57] ABSTRACT

A relay for use in automotive vehicles. The construction of the relay allows the assembly of all the contacts and relay armature through a contact chamber open at one end. The chamber is formed by a unitary coil winding support and contact chamber closed on all sides but the one open end. The open side is adapted to be covered by the mounting of the relay to a printed circuit board with the contact spring terminals adapted to extend from the relay structure to extend through the board.

6 Claims, 4 Drawing Figures

ELECTROMAGNETIC RELAY

From the German Patent DE-AS No. 1 764 496 a relay is known in which a winding support of plastic material can be locked to a preassembled unit with a mounting plate of insulation material, which is designed as a cup-shaped contact chamber. A sheet metal housing is finally slipped over said unit. The edge of the sheet metal housing is flanged, whereby the mounting plate and the winding support are held together.

In this known embodiment the contacts are indeed protected in the contact chamber, but it is very difficult to mount the relay and it takes a lot of time, because three parts have to be assembled to each other.

Also the assembly of the contact in the contact chamber of this known embodiment is very complicated, because the piece parts have to be inserted into the contact chamber in different directions.

The present invention was designed to resolve the problem of improving a relay of the above mentioned type in a manner that the assembly will be substantially facilitated and thereby to make possible a more economical production. Of course, the functioning thereby is not degraded. Especially it is important to enable the switching of high current without an unduly high drop in voltage. Because of this reason it is important that the current supply to the movable contact spring is effected as directly as possible.

Major advantages of the invention are as follows: Assembly work can be saved by producing the winding support and the contact chamber in one piece. No additional member is necessary to connect winding support and contact chamber. It is possible to assemble the piece parts in the contact chamber automatically, because all parts can be inserted in the same direction into the contact chamber open on one side. The contacts are protected in this contact chamber, because after the assembly of the relay the open lateral surface rests upon a plug base or a printed circuit board.

An essential advantage can also be achieved by the preassembly of the contact tag, the contact spring and readjustment spring as a unit because on the one hand the assembly of the movable contact spring is facilitated and besides only two contact resistances become effective between the plug contact for this contact spring and the actual contact on said contact spring. Further it is of importance that an additional readjusting spring with low conductivity may be directly assembled with this constructional unit. In contrast thereto in the initially mentioned type of relay, a spiral spring serves for the purpose of readjusting the armature, whereby said spiral spring has to be inserted separately into the contact chamber. It is also important that said readjusting spring conducts practically no current and therefore also retains its elasticity and readjusting force, since the current load and the resultant heating up of the actual contact spring rises to unduly high values in case of trouble.

Figure 1:
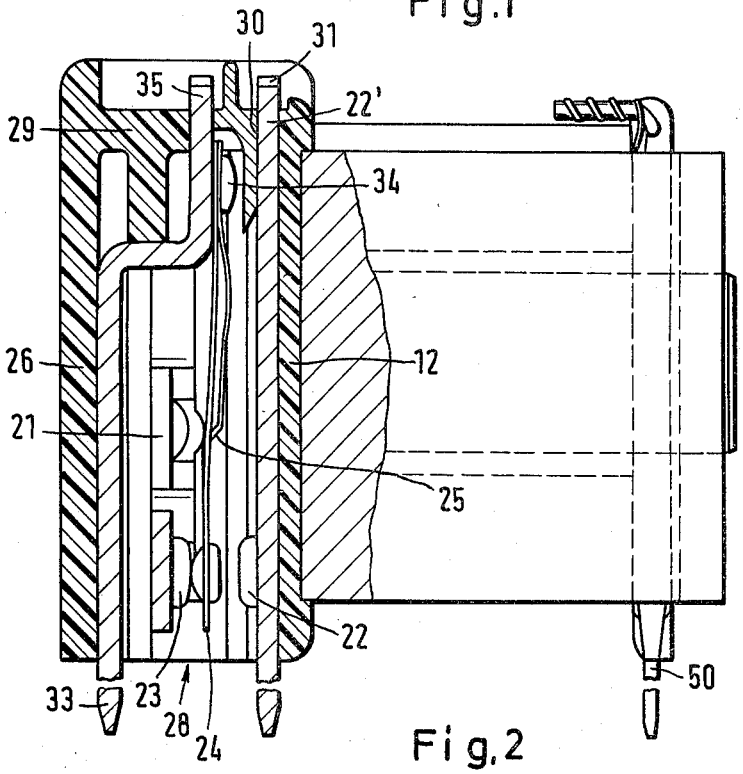
Figure 2:
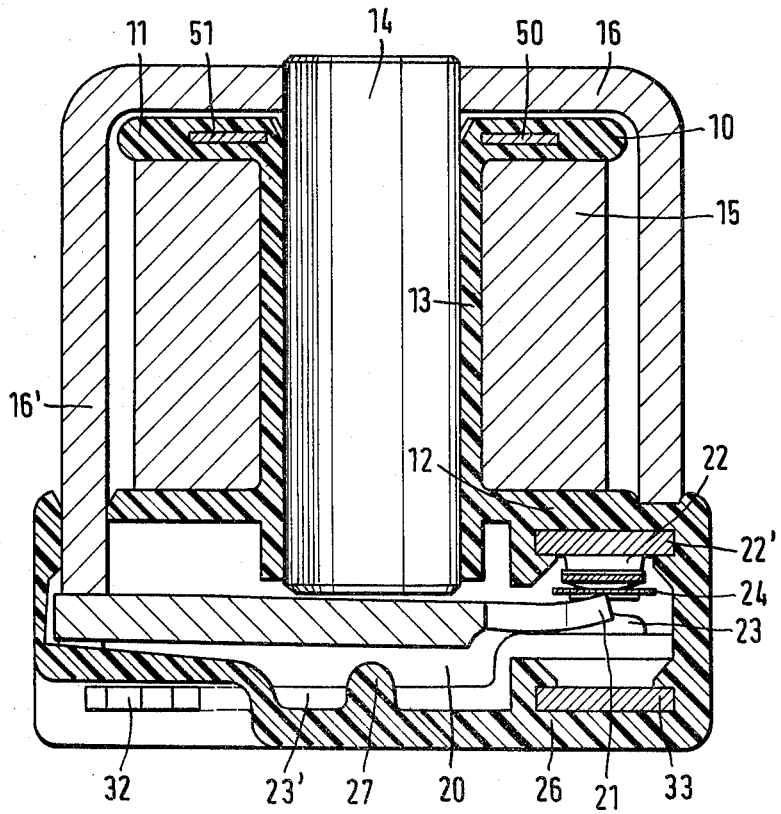
Figure 4:
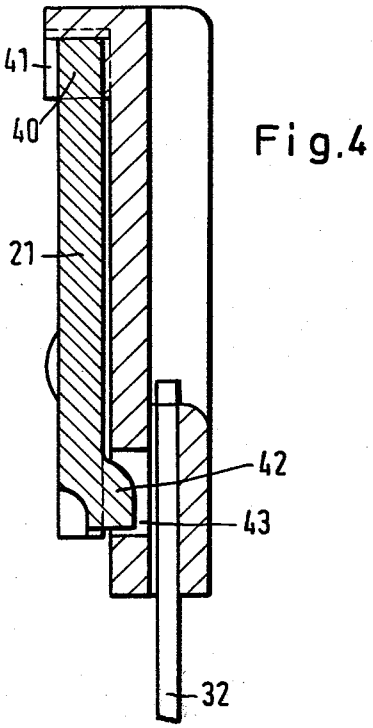
Figure 3:
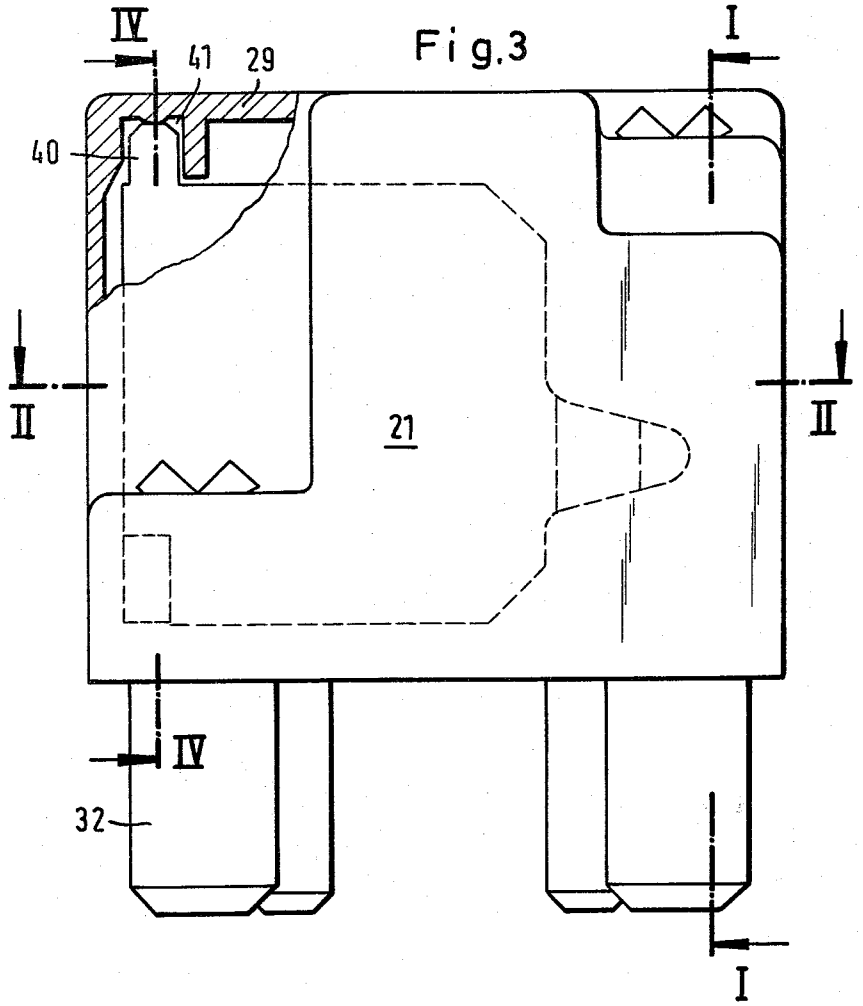

The invention is described below by way of the preferred embodiment shown in the accompanying drawings, in which FIG. 1 is a partial section of a relay in its normal or at rest position taken on the line I—I of FIG. 3, FIG. 2 is a section of a relay in the operated position taken on the line II—II of FIG. 3, FIG. 3 is a side view of the relay with the contact chamber shown in partial section and FIG. 4 is a section taken on the line IV—IV of FIG. 3.

The relay has a winding support 10 (FIG. 2) with a bottom plate 11 and a mounting plate 12 on the front side of a hollow cylinder 13 receiving the magnetic core 14 and the coil 15 is wound on said hollow cylinder. A U-shaped magnet yoke 16 is fixed on the magnetic core 14.

In an aproximately rectangular contact chamber as a whole, designated by 20, a movable armature 21, a first stationary contact (make contact 22) and a second stationary contact (break contact 23), a movable contact spring 24 as well as a readjusting leaf spring 25 are accommodated. As can be clearly seen from FIG. 1 and 2 said contact chamber 20 and the winding support 10 are integrally made of plastic material. The mounting plate 12 of the winding support 10 simultaneously represents a surface of the contact chamber 20 and separates the contact chamber from the coil. The opposed or opposite bottom wall 26 has a stop 27 in order to limit the readjusting motion of armature and contact spring if the relay—varying from the embodiment shown—has only a make contact.

The contact chamber 20 has an open lateral surface 28 (FIG. 1) which is located opposite to the side wall 29. Especially in FIG. 1 it can be seen that the stationary contact spring or tag 22' carrying the make contact 22 can be inserted into the contact chamber 20 via the open lateral surface 28 and the end of said contact tag 22 can be plugged through a slot 30 in the opposite side wall 29. The contact tag 22' is held in said contact chamber by split riveting. The same is true for the contact tag 22' of the break contact 23 which is secured in opening 32 by split riveting.

A further stationary contact spring 33 is welded or riveted with the movable contact spring 24 and the readjusting leaf spring 25 at 34. Also this preassembled constructional unit is inserted into the contact chamber through the open lateral surface 28 and at 35 is held in the side wall 29 by split riveting. Finally also the movable armature 21 is inserted into the contact chamber 20 via the open lateral surface 28. This armature 21 is designed as a nearly square lamina. A laterally projecting pin 40 of armature engages in a pocket 41 of the side wall 29, whereby said pocket is open in direction of insertion. A second pin 42 (FIG. 4) is curved from the armature plane and snaps into a pocket 43 in the bottom wall 26. Said pocket 43 has an opening extending transversally to the direction of insertion. Via the two pins 40 and 42 the armature 21 thus is povitally mounted in the contact chamber 20 round an axle which extends transversely to the direction of insertion. The one leg 16' of the magnet yoke 16 is elongated and projects into the switch chamber 20 in a way that the armature 21 rests upon the front surface of said leg.

All contact tags project from the open front surface 28 and each has its project end shaped to act as a terminal for external connecting. Two further contact tags 50 and 51 are anchored in the bottom plate 11 of the winding support 10. Also the ends of these contact tags all adjusted in the same direction are directly formed as contact plugs or terminals.

If thus a relay is inserted into a socket or soldered on a printed circuit board, the contact chamber 20 is completely closed, whereby the open lateral surface 28 is covered by said socket or printed circuit board. Thus a relay is created the contacts of which are on all sides protected in a contact chamber. This relay can be very easily assembled, because the contact chamber and the winding support are injection-moulded in one piece and because all components can be inserted into the contact chamber in the same direction of assembly and hence, if required, completely automatically. The relay is suitable to switch high currents with a low drop in voltage, because all contacts are directly arranged on the contact tags formed as connectors.

What we claim is:

1. Electromagnetic relay adapted for use in motor vehicles, comprising a winding support carrying an operating coil, a magnetic core and a magnet yoke secured on said winding support, and comprising a contact chamber in which a movably mounted armature for actuating a contact spring and stationary contacts springs are located, the improvement wherein the winding support and the contact chamber are made in one piece of plastic material, the contact chamber is substantially rectangular and has one end open to enable the insertion into the chamber of the stationary contact springs, the movable contact spring and the armature.

2. Relay as claimed in claim 1, in which the stationary contact springs and a contact spring tag connected with the movable contact spring project from the lateral surface of said open end as contact terminals and on the opposite lateral side wall of the contact chamber are plugged in slots and afterwards squeezed, riveted or pressed in.

3. Relay as claimed in claim 2, in which the contact tag and the movable contact spring as well as an additional readjusting leaf spring are preassembled as a unit suitably secured to one another.

4. Relay as claimed in claim 3, characterized in that the conductivity of the readjusting leaf spring is substantially less than the conductivity of the movable contact spring.

5. Relay as claimed in claim 1, in which the armature is provided with a first pin extending from a lateral surface opposite the open end for engaging a pocket open in direction of insertion and with a second pin which is bent at an angle from of the plane of the armature, said second pin engaging into a pocket open transversely to the direction of insertion and located in the bottom of the contact chamber.

6. Relay as claimed in claim 2, in which the stationary contact springs are molded in said winding support as coil terminals projecting from the winding support in the same direction as the contact terminals project from the contact chamber.

* * * * *